United States Patent [19]

Foster et al.

[11] Patent Number: 5,061,608

[45] Date of Patent: Oct. 29, 1991

[54] PHOTOGRAPHIC BLEACHING SOLUTION AND USE THEREOF IN PHOTOGRAPHIC COLOR PROCESSING

[75] Inventors: David G. Foster, W. Henrietta; Keith H. Stephen, Rochester, both of N.Y.

[73] Assignee: Eastman Kodak Company, Rochester, N.Y.

[21] Appl. No.: 689,088

[22] Filed: Apr. 19, 1991

Related U.S. Application Data

[63] Continuation of Ser. No. 469,102, Jan. 24, 1990, abandoned.

[51] Int. Cl.[5] ..... G03C 5/44

[52] U.S. Cl. ..... 430/461; 430/393; 430/430; 252/186.1

[58] Field of Search ..... 430/393, 430, 461; 252/186.1

[56] References Cited

U.S. PATENT DOCUMENTS 4,242,442 12/1980 Idota et al. ..... 430/393
4,268,618 8/1981 Hashimura ..... 430/393
4,444,873 1/1984 Ishikawa et al. ..... 430/393
4,780,398 10/1988 Kim ..... 430/461
4,822,725 4/1989 Abe et al. ..... 430/393

FOREIGN PATENT DOCUMENTS 3723307 12/1989 Fed. Rep. of Germany .

*Primary Examiner*—Charles L. Bowers, Jr.
*Assistant Examiner*—Janis L. Dote
*Attorney, Agent, or Firm*—Alfred P. Lorenzo

[57] ABSTRACT

An environmentally advantageous photographic bleaching solution for use in the color processing of photographic elements comprises (1) as a bleaching agent, a potassium salt of a ferric complex of an aminopolycarobxylic acid, (2) as an agent which functions to convert silver to silver halide, a potassium halide, and (3) as an agent which functions to inhibit bleach induced dye formation, a water-soluble aliphatic carboxylic acid. The bleaching solution is especially useful in the processing of photographic elements containing a low pKa, high-activity, yellow-dye-forming coupler in that it serves to effectively avoid the undesirable increase in blue $D_{min}$ that can occur in such elements as a result of bleach induced dye formation.

8 Claims, No Drawings

PHOTOGRAPHIC BLEACHING SOLUTION AND USE THEREOF IN PHOTOGRAPHIC COLOR PROCESSING

This is a continuation of application Ser. No. 469,102, filed Jan. 24, 1990, now abandoned.

FIELD OF THE INVENTION

This invention relates in general to photography and in particular to a novel bleaching solution for the bleaching of photographic elements. More specifically, this invention relates to an environmentally advantageous photographic bleaching solution which is useful in the color processing of photographic elements.

BACKGROUND OF THE INVENTION

In the production of color photographic images, it is necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones.

It is particularly well known to use a ferric complex of an aminopolycarboxylic acid as a bleaching agent in photographic color processing. Such complexes are used in both bleaching compositions and bleach-fixing compositions. A very large number of different compounds of the aminopolycarboxylic acid class are disclosed in the prior art as being useful photographic bleaching agents. However, the usual commercial practice is to use an ammonium or alkali metal salt of a ferric complex of ethylenediaminetetraacetic acid (EDTA) or of a ferric complex of propylenediaminetetraacetic acid (PDTA).

Among the numerous patents describing the use of ferric complexes of aminopolycarboxylic acids in bleaching and/or bleach-fixing baths are U.S. Pat. Nos. 3,241,966, 3,615,508 and 3,767,401 and British patents 1,365,453, 1,392,163, and 1,394,357.

The prior art indicates that ferric complexes of an aminopolycarboxylic acid can be employed in photographic bleaching solutions in the form of ammonium or alkali metal salts, such as sodium or potassium salts. However, the use of ammonium salts is undesirable from an environmental standpoint and the use of sodium salts provides an undesirably sluggish bleaching action. Thus, it is especially advantageous to utilize photographic bleaching solutions which comprise a potassium salt of a ferric complex of an aminopolycarboxylic acid as the bleaching agent, since these solutions are both fast-acting and environmentally acceptable.

A serious problem is encountered, however, in utilizing a photographic bleaching solution containing a potassium salt of a ferric complex of an aminopolycarboxylic acid. In particular, when such a bleaching solution is used to bleach a photographic element containing a low pKa, high-activity, yellow-dye-forming coupler, a significant and highly undesirable increase in blue $D_{min}$ results from bleach induced dye formation. The term "bleach induced dye formation" refers to reaction between the coupler and oxidized developing agent that takes place in the bleaching solution and leads to the generation of image dye and thus to stain formation. Formation of yellow image dye in this manner and resulting increase in blue $D_{min}$ is particularly acute with the low pKa, high-activity, yellow-dye-forming couplers that are used in many photographic films. The problem also occurs with the other image layers, but to a much lesser extent.

It is toward the objective of providing an improved photographic bleaching solution that is fast-acting, and environmentally acceptable—and sufficiently resistant to the phenomenon of bleach induced dye formation that it is highly useful with photographic elements containing a low pKa, high activity, yellow-dye-forming coupler—that the present invention is directed.

SUMMARY OF THE INVENTION

In accordance with this invention, an environmentally advantageous photographic bleaching solution for use in the color processing of photographic elements is an aqueous acidic solution which is substantially free of ammonium salts and comprises (1) as a bleaching agent, a potassium salt of a ferric complex of an aminopolycarboxylic acid, (2) as an agent which functions to convert silver to silver halide, a potassium halide, and (3) a sufficient amount of a water-soluble aliphatic carboxylic acid to inhibit bleach induced dye formation.

The present invention is based, in major part, on the unexpected discovery that water-soluble aliphatic carboxylic acids, when used in sufficient concentration, will effectively eliminate the problem of bleach induced dye formation and thus avoid unwanted staining that occurs in photographic processing. While water-soluble aliphatic carboxylic acids have been commonly used in photographic bleach solutions heretofore, they have usually been used to adjust pH and use for this purpose does not require the high concentration of acid that is optimally used to effectively eliminate the problem of bleach induced dye formation.

DESCRIPTION OF THE PREFERRED EMBODIMENTS

As indicated above, the essential components of the novel bleaching solution of this invention are a potassium salt of a ferric complex of an aminopolycarboxylic acid, a potassium halide, and a water-soluble aliphatic carboxylic acid.

The potassium salt of the ferric complex of an aminopolycarboxylic acid can be employed in any effective amount, with useful amounts typically being at least 0.1 moles per liter of bleaching solution, and preferably at least 0.5 moles per liter. Examples of the many useful ferric complexes include complexes of:

nitrilotriacetic acid,
ethylenediamine tetraacetic acid,
propylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid,
iminodiacetic acid,
methyliminodiacetic acid, ethyliminodiacetic acid,
and the like.

In some instances the use of a mixture of bleaching agents is preferred over the use of individual bleaching agents, since a mixture can provide a desired level of bleaching power intermediate that of the individual bleaching agents of which it is composed. Examples of particularly useful mixtures include a mixture of the ferric complex of ethylenediaminetetraacetic acid and the ferric complex of propylenediaminetetraacetic acid, a mixture of the ferric complex of ethylenediaminetetraacetic acid and the ferric complex of methyliminodiacetic acid, and a mixture of the ferric complex of iminodiacetic acid and the ferric complex of methyliminodiacetic acid.

Potassium halides useful in the bleaching solutions of this invention include potassium chloride and potassium bromide. The potassium halide can be employed in any effective amount, with useful amounts typically being at least 0.1 moles per liter, and preferably at least 0.25 moles per liter.

Water-soluble aliphatic carboxylic acids useful in the bleaching solutions of this invention include acetic acid, propionic acid and succinic acid.

The water-soluble aliphatic carboxylic acid can be employed in any effective amount, with useful amounts typically being at least 0.35 moles per liter of bleaching solution, preferably at least 0.7 moles per liter, and most preferably at least 0.9 moles per liter.

The bleaching solutions of this invention are aqueous acidic solutions preferably having a pH in the range of from about 4 to about 6.8 and most preferably in the range of from 4.5 to 5.5.

The bleaching solutions of this invention can contain other addenda known in the art to be useful in bleaching compositions, such as sequestering agents, sulfites, and non-chelated salts of aminopolycarboxylic acids.

The compositions of this invention are bleaching solutions and not bleach-fixing solutions, and thus they are substantially free of fixing agents. The term "bleaching solution" as used herein is intended to exclude bleach-fixing solutions.

A particularly useful sequestering agent which can be included in the bleaching solution of this invention to avoid the unwanted precipitation of salts is 1,3-diamino-2-propanol tetraacetic acid.

The bleaching solutions of this invention are especially useful in the color processing of photographic elements, including photographic films utilized in negative-positive processes or in color reversal processes. Useful processes include a three-step process—comprising the steps of color developing, bleaching and fixing—and a six-step process—in which the film is processed in a first developer, a reversal bath, a color developer, a conditioning bath, a bleach bath and a fixing bath. The processing is typically carried out using a color developing solution which contains a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediaminemonohydrochloride,
4-N,N-diethyl-2-methylphenylenediamine monohydrochloride,
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride,
and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent.

In both the negative-positive process and the color reversal process, the fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

A commercially important process intended for use with color negative photographic elements which contain the couplers in the silver halide emulsion layers, or in layers contiguous thereto, utilizes, in order, the following processing baths: color developer, wash (optional), bleach, fix, wash and stabilizer. In accordance with this invention, such a process is carried out using the novel bleaching solution described hereinabove.

A commercially important process intended for use with color reversal photographic elements which contain the couplers in the silver halide emulsion layers, or in layers contiguous thereto, utilizes, in order, the following processing baths: first developer, wash, reversal bath, color developer, bleach, fix, wash and stabilizer. In this process, the first developer reduces the exposed silver halide to metallic silver; the reversal bath nucleates the silver halide that remains after first development, the color developer converts the nucleated silver halide to metallic silver and forms the dye images, the bleach converts all metallic silver to silver halide, the fix converts the silver halide into soluble silver complexes that are washed from the element, and the stabilizing bath improves image dye stability. In accordance with this invention, such a process is carried out using the novel bleaching solution described hereinabove.

The novel bleaching solutions of the present invention can be utilized with any of a wide variety of photographic elements. For a detailed description of useful photographic elements and methods for their manufacture, reference can be made to Research Disclosure, Item 17643, Vol. 176, December, 1978, published by Industrial Opportunities Ltd., Homewell, Havant Hampshire, P09 1EF, United Kingdom.

The photosensitive layers present in the photographic elements processed with the novel bleaching solutions of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, polymer-coated paper, and the like.

It is generally convenient for the ferric complex of the aminopolycarboxylic acid to be formed in situ in the bleaching solution by reaction of a ferric salt, such as ferric sulfate or ferric nitrate, with an aminopolycarboxylic acid or mixture of aminopolycarboxylic acids.

In the present invention, potassium hydroxide is advantageously incorporated in the bleaching solution for the purpose of providing the desired potassium ions and maintaining the pH within the desired range.

The bleaching solution of this invention is free, or at least substantially free of ammonium salts, as the presence of ammonium ions in a photographic bleaching solution is environmentally disadvantageous.

It is especially desirable that the bleaching solution of this invention have a total iron content of less than 10 grams per liter. For environmental reasons, it is preferred to keep the total iron content of photographic bleaching solutions as low as possible.

The problem of bleach induced dye formation is more severe with a bleaching solution containing potassium salts than with an otherwise comparable bleaching solution containing ammonium salts. Applicants are uncertain of the theoretical explanation for this, but it is believed that ammonium ions may act as an acid in the bleaching solution while potassium ions do not. The acidity imparted by the ammonium ions is believed to reduce the tendency for bleach induced dye formation to occur.

As indicated hereinabove, a very serious problem exists in processing photographic films that contain low pKa, high-activity, yellow-dye-forming couplers since such films tend to undergo a highly undesirable increase in blue $D_{min}$ resulting from bleach induced dye formation. Acid strengths in water solutions are defined in terms of the equilibrium constant, Ka, for the reaction:

$$HA + H_2O \rightarrow H_3O^+ + A^-$$

pKa is defined by the equation:

$$pKa = -\text{LOG } Ka \text{ where}$$

$$Ka = \frac{[H_3O^+][A^-]}{[HA]}$$

The greater the value of Ka, and smaller the value of pKa, the stronger the acid. Couplers having a low pKa tend to be completely ionized in water. The activity of a coupler refers to its ability to form dye by reaction with oxidized developing agent. High activity couplers tend to produce very high $D_{max}$ values and are especially beneficial for this reason.

Low pKa, high-activity, yellow-dye-forming couplers are well known in the prior art and are described, for example, in U.S. Pat. Nos. 4,352,873, 4,476,219 and 4,522,916.

The invention is further illustrated by the following examples of its practice.

An aqueous acidic photographic bleaching solution was prepared in accordance with the following formulation:

| | |
|---|---|
| 1,3-propylenediaminetetra-acetic acid - | 37.4 grams (0.122 moles) |
| Potassium hydroxide (45% solution) - | 70 milliliters |
| Acetic acid* - | 50 milliliters |
| 1,3-diamino-2-propanol tetraacetic acid - | 0.8 grams |
| Potassium bromide - | 30 grams (0.25 moles) |
| $Fe(NO_3)_3 \cdot 9H_2O$ - | 44.85 grams in 100 milliliters of water |
| Water to one liter. | pH = 4.75 |

*1 mole of acetic acid corresponds to 60 grams or 57 milliliters

The above-described bleaching solution was employed in the processing of a photographic negative-positive color film utilizing a conventional process comprising the steps of color developing, bleaching, fixing, washing and stabilizing. The film contained a low pKa, high-activity yellow-dye-forming coupler of the formula:

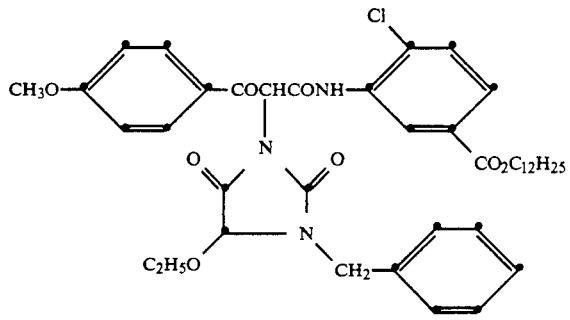

Contact with the bleaching solution was carried out at 33° C. for 3 minutes.

The content of acetic acid in the bleaching solution was varied as indicated below, while all other factors were held constant, and for each sample of bleaching solution tested the blue $D_{min}$ was measured. Adjustment of pH of the bleach solution, necessitated by change in the acetic acid content, was accomplished by addition of sulfuric acid or potassium carbonate to give in each case a pH of 4.75.

Results obtained were as follows:

| Concentration of Acetic Acid | | |
|---|---|---|
| Milliliters | Moles | Blue $D_{min}$ |
| 10 | 0.175 | 1.15 |
| 20 | 0.350 | 0.86 |
| 40 | 0.700 | 0.80 |
| 50 | 0.875 | 0.80 |
| 60 | 1.05 | 0.79 |
| 80 | 1.40 | 0.79 |

As indicated by the above data, the blue $D_{min}$ declines sharply as the acetic acid concentration is increased to a level of about 0.7 moles per liter of bleaching solution and then levels off. This results from the fact that, over the effective range, increasing the acetic acid level causes a corresponding decrease in bleach induced dye formation. Thus, amounts of acetic acid of at least 0.7 moles per liter are preferred and, to provide added assurance of maintaining optimum conditions, amounts of at least 0.9 moles per liter are particularly preferred. The ability of water-soluble aliphatic carboxylic acids, such as acetic acid, to provide this improved result is clearly unexpected on the basis of what was known heretofore in the prior art.

The invention has been described in detail with particular reference to preferred embodiments thereof, but it will be understood that variations and modifications can be effected within the spirit and scope of the invention.

We claim:

1. An aqueous acidic photographic bleaching solution which is substantially free of ammonium salts and comprises (1) as a bleaching agent, a potassium salt of a ferric complex of an aminopolycarboxylic acid, (2) as an agent which functions to convert silver to silver halide, potassium bromide and (3) as an agent which inhibits bleach-induced dye formation, a water-soluble aliphatic carboxylic acid, selected from the group consisting of acetic acid, propionic acid and succinic acid, in an amount of at least 0.35 moles per liter.

2. The bleaching solution as claimed in claim 1 wherein the pH is in the range of from about 4 to about 6.8, said potassium salt of a ferric complex of an aminopolycarboxylic acid is present in an amount of at least 0.1 moles per liter of bleaching solution, said potassium bromide is present in an amount of at least 0.25 moles per liter of bleaching solution, and said water-soluble aliphatic carboxylic acid is present in an amount of at least 0.7 moles per liter of bleaching solution.

3. The bleaching solution as claimed in claim 1 wherein the pH is in the range of from 4.5 to 5.5, said potassium salt of a ferric complex of an aminopolycarboxylic acid is present in an amount of at least 0.5 moles per liter of bleaching solution, said potassium bromide is present in an amount of at least 0.25 moles per liter of bleaching solution, and said water-soluble aliphatic carboxylic acid is present in an amount of at least 0.9 moles per liter of bleaching solution.

4. The bleaching solution as claimed in claim 1 wherein said ferric complex is a ferric complex or ethylenediaminetetraacetic acid.

5. The bleaching solution as claimed in claim 1 wherein said ferric complex is a ferric complex of propylenediaminetetraacetic acid.

6. The bleaching solution as claimed in claim 1 wherein said solution comprises ferric complexes of both ethylenediaminetetraacetic acid and propylenediaminetetraacetic acid.

7. The bleaching solution as claimed in claim 1 wherein said water-soluble aliphatic carboxylic acid is acetic acid.

8. An aqueous acidic photographic bleaching solution which is substantially free of ammonium salts, said solution having a pH in the range of from about 4 to about 6.8 and comprising (1) as a bleaching agent, the potassium salt of the ferric complex of propylenediaminetetraacetic acid in an amount of at least 0.1 moles per liter, (2) as an agent which functions to convert silver to silver halide, potassium bromide in an amount of at least 0.25 moles per liter, and (3) as an agent which functions to inhibit bleach induced dye formation, acetic acid in an amount of at least 0.7 moles per liter.

* * * * *